US006338615B1

(12) United States Patent
Hurr et al.

(10) Patent No.: US 6,338,615 B1
(45) Date of Patent: Jan. 15, 2002

(54) PIPE SWITCH FOR TWO-CYLINDER THICK-MATERIAL PUMP

(75) Inventors: Hellmut Hurr, Reutlingen; Hartmut Benckert; Karl Schlecht, both of Filderstadt, all of (DE)

(73) Assignee: Putzmeister Aktiengesellschaft (DE)

( * ) Notice: Subject to any disclaimer, the term of this patent is extended or adjusted under 35 U.S.C. 154(b) by 0 days.

(21) Appl. No.: 09/601,527

(22) PCT Filed: Jan. 19, 1999

(86) PCT No.: PCT/EP99/00301

§ 371 Date: Aug. 2, 2000

§ 102(e) Date: Aug. 2, 2000

(87) PCT Pub. No.: WO99/40320

PCT Pub. Date: Aug. 12, 1999

(30) Foreign Application Priority Data

Feb. 4, 1998 (DE) ..... 198 04 072
Dec. 24, 1998 (DE) ..... 198 60 185

(51) Int. Cl.[7] ..... F04B 7/00
(52) U.S. Cl. ..... 417/517; 417/532
(58) Field of Search ..... 417/401, 403, 417/516–518, 532

(56) References Cited

U.S. PATENT DOCUMENTS 4,198,193 A * 4/1980 Westerlund et al. ..... 417/517
RE32,657 E * 4/1988 Schwing ..... 417/517
RE32,719 E * 7/1988 Schwing ..... 417/517
5,037,275 A * 8/1991 Schlecht ..... 417/517
5,302,094 A * 4/1994 Schlecht et al. ..... 417/517

* cited by examiner

*Primary Examiner*—Charles G. Freay
(74) *Attorney, Agent, or Firm*—Pendorf & Cutliff

(57) ABSTRACT

The present invention relates to a pipe switch for a dual-cylinder thick-liquid pump, wherein said system comprises a pivoting pivot pipe (36) located in the front of a glasses-like wear plate (34) on the cylinder side as well as a wear ring (38) which is capable of limited axial displacement at the end of the pivot pipe (36) on the cylinder side. The ring can be pressed against the wear plate (34) by the hydrostatic pressure existing inside said pivot pipe. The wear ring 38 has a centering portion (46) guided on an axis-parallel centering surface (42) of the pivot pipe (36) as well as a sealing part (54) resting against the wear plate (34) through an abutment surface (52) on the cylinder side. The pivot pipe (36) and the sealing part (54) of the wear ring (38) have annular surfaces (56, 58) which face each other and which are axially spaced from one another by an annular gap (59) opened towards the inside of the pipe. An annular system (60) exhibiting at least a rubber elasticity is further provided, wherein said system axially covers the annular gap (59) and has its abutment surfaces (62, 64) resting in a prestressed manner against each of the annular surfaces (56, 58). In order to allow for an automatic anti-wear readjustment of the wear ring, the annular system (60) has an axial annular support (80) provided on its abutment surface (62) which faces the centering portion (46) of the wear ring (38), wherein said support (80) is made of a wear-resistant material which is more rigid than the rubber-elastic material.

26 Claims, 5 Drawing Sheets

PIPE SWITCH FOR TWO-CYLINDER THICK-MATERIAL PUMP

BACKGROUND OF THE INVENTION

FIELD OF THE INVENTION

The invention concerns a pipe switch for two-cylinder thick material pumps with a pivot pipe pivotable in front of a two-opening wear plate on the cylinder side, with a wear ring which can be pressed against the wear plate in the rim area of the opening by the hydrostatic pressure present inside the pivot pipe, the wear ring capable of limited axial displacement at the end of the pivot pipe on the cylinder side, the wear ring having a centering portion guided on an axis-parallel centering surface of the pivot pipe as well as a sealing part resting against the wear plate via an abutment surface on the cylinder side, wherein the pivot pipe and the sealing part of the wear ring have opposing annular surfaces which are axially spaced from one another thereby forming an annular gap open towards the inside of the pipe, and with a ring arrangement comprised at least in part of a rubbery elastic material axially spanning the annular gap, the ring arrangement with its respective abutment surfaces lying preferably in a pre-stressed manner against each of the annular surfaces.

SUMMARY OF THE INVENTION

Tubular branching systems of this kind, which have an automatically hydrostatic adjusting wear ring, are known (DE-A 26 14 895, EP-B 0 656 995). In the annular space there is a rubber elastic ring, which is provided for sealing the gap formed between the centering part and the centering surface and additionally performs a spring function for pressing the sealing part of the wear ring against the wear plate. In practice it has been found that during operation cement deposits form in the area of the radial plane oriented ring surfaces, which despite a material removal in the area of the sealing part and the wear plate could lead to an uncontrolled narrowing of the annular space and to a wearing out of the rubber elastic ring, with a result, that the rubber elastic ring can be pressed out, towards the inside of the pipe, and can be lost.

Beginning therewith it is the task of the present invention to improve the known pipe switch of the above-described type in such a manner, that the rubber elastic material of the ring arrangement is not subjected to excessive wear.

The inventive solution is based on the concept, that the rubber elastic material is to be protected from the abrasive effect of the cement with suitable means. In order to achieve this, it is proposed in accordance with a first inventive embodiment, that the ring arrangement at least on its surface facing the centering part of the wear ring has an axial ring overlay of a wear retardant material which is stiffer than the rubber elastic material. Preferably the ring overlay is comprised of metal, of a metal or textile fabric, of plastic, or of hard rubber. The ring overlay can be adhered to or vulcanized onto the rubber elastic material.

An alternative or advantageous embodiment of the invention envisions that the ring arrangement includes at least two rings of rubber elastic material separated from each other by a hard intermediate ring. The intermediate ring is preferably formed as a metallic ring disk, which has the same inner and outer diameter as the rubber elastic rings. The intermediate ring can be loosely introduced in the ring space between the rubber elastic rings and be provided with multiple through holes separated from each other in angular separation.

Preferably the rubber elastic rings are connected to each other via multiple axially parallel pins arranged in angular separation from each other, which pins extend through the through holes in the intermediate ring.

According to a preferred embodiment of the invention the rubber elastic rings are vulcanized onto the intermediate ring at their respective contacting surfaces.

A further alternative or advantageous embodiment of the invention envisions that the ring arrangement is formed by a rubber elastic ring with a co-axial helical spring vulcanized therein. The helical spring is preferably comprised of spring steel and can be introduced into the rubber elastic ring pretensioned under pressure. In the later case the rubber elastic material is expanded by the helical coil spring in the loose ring arrangement, so that in the assembled condition pretensioned within the annular space a supplemental adjustment means is made available.

According to a further alternative or advantageous embodiment of the invention it is proposed that the ring surface adjacent the centering part in a known manner exhibits an annular step formed by a recess facing in the direction of the centering part, undercut with respect to the inside of the pipe, and that a ring seal of elastomeric material separate from the ring arrangement is seated in the annular step. The ring seal has the task of preventing a passage of material through the centering gap, and thereby to minimize the cement deposit on the ring surface facing the centering gap. The ring seal is preferably over-dimensioned with respect to the annular step, which is so dimensioned, that the ring seal is pressed in the annular step under the pretension of the ring arrangement. The ring seal can thereby either exhibit a quadrilateral, in particular, a square cross-section or a round or oval cross-section. Since the inside of the annular step is completely enclosed, it is possible to use therefore a soft elastic material without stiffening. The ring arrangement could in this case be comprised of a one-piece elastomeric ring with a stiffening insert, for example a metal ring.

For sealing the ring gap in the centering surface, in accordance with an advantageous or alternative design of the invention a ring notch can be provided in the centering surface of the pivot pipe or in the centering part of the wear ring, for receiving a ring seal for bridging the annular gap between the centering surface and the centering part.

In order to guarantee a reliable sealing of the ring space over a long operating time, it is proposed in accordance with a further advantageous or alternative embodiment of the invention to have a tensioning mechanism provided between the pivot pipe and wear ring, with which the pretensioning of the ring arrangement can be adjusted. The tensioning mechanism preferably includes at least two, more preferably three tensioning screws distributed about the circumference of the pivot pipe and displaceable axially parallel with respect to the pivot pipe, each tensioning screw engaging respectively in an axis-parallel oriented thread of the wear ring. The tensioning screws are preferably formed as set screws guided with their shaft respectively in a rim open axial guide of the pivot pipe and their head is supported against a shoulder bordering against the axial guide.

BRIEF DESCRIPTION OF THE DRAWINGS

In the following the invention will be described in greater detail on the basis of an illustrative embodiment represented in schematic manner in the drawings. There is shown FIG. 1 a thick material pump with C-shaped pivot pipe in partial sectional diagrammatic perspective representation.

DETAILED DESCRIPTION OF THE INVENTION

Figure 1:
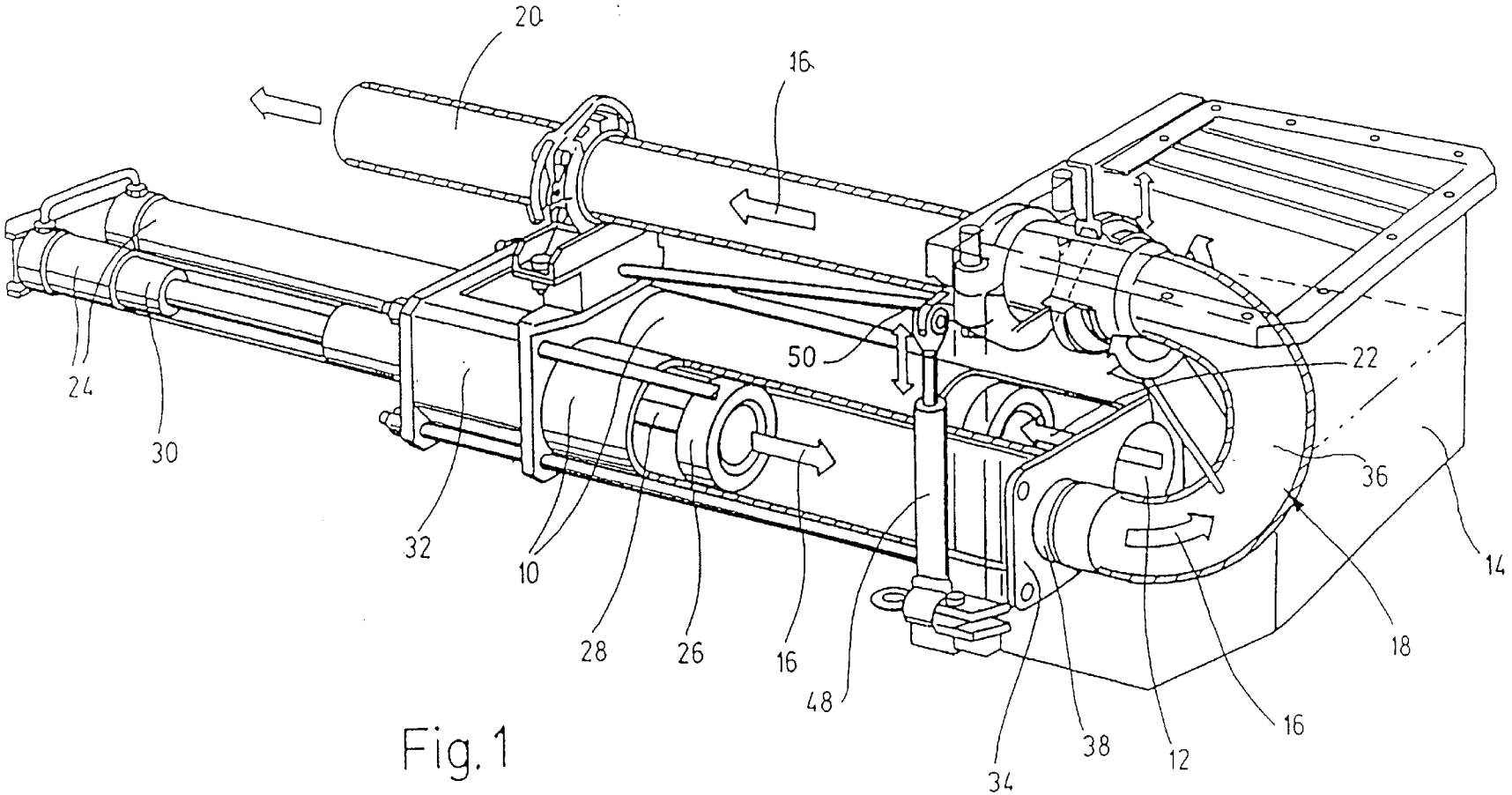

The thick material pump shown in FIG. 1 is comprised essentially of two conveyance cylinders 10, of which the end openings 12 open into a material supply container 14 and alternatingly during the pressure stroke (arrow 16) are in communication with a conveyance line 20 via a pipe switch 18 and during the suction stroke (arrow 22) are open to the material supply container 14 with suctioning of material. The conveyance cylinders 10 are operated reciprocally, in counter-stroke, via a hydraulic drive cylinder 24. For this purpose the conveyor pistons 26 are connected via a common piston rod 28 with the piston 30 of the drive cylinder 24. In the area between the conveyor cylinders 10 and the drive cylinders 24 there is a water box 32 through which the piston rods 28 extend.

The end openings 12 of the conveyor cylinders 10 are covered by a glasses-shaped wear plate 34. On the inner side of the material supply container 14 the pivot pipe 36 of the pipe switch 18, which in the illustrative embodiment is C-shaped, is pivotable back and forth about a horizontal axis in front of the glasses shaped wear plate 34, with its friction ring 38 carried inside, such that its cylinder facing opening 40 alternatingly is positioned before the one of the openings 12 of the conveyor cylinders 10 while exposing the other opening 12 to the inner side of the material container 14. For the pressure tight connection between the pivot pipe 36 and the wear plate 34 there is on the cylindrical centering surface 42 of the pivot pipe 36 the wear ring 38 mounted with its centering part 46 axially displaceable. The operation of the pivot pipe 36 occurs via hydraulic means 48 controllable via a switch lever 50.

Figure 2:
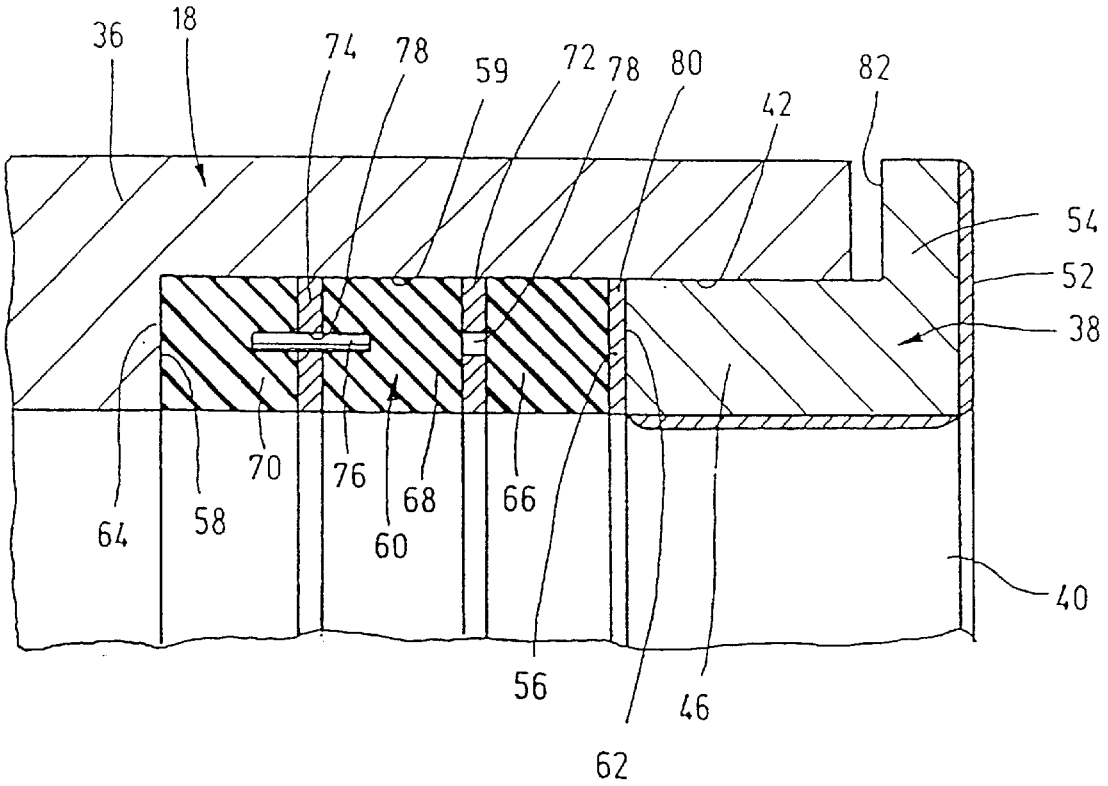
FIG. 2 an enlarged section from the pipe switch with internally centered wear ring in sectional representation.
Figure 3:
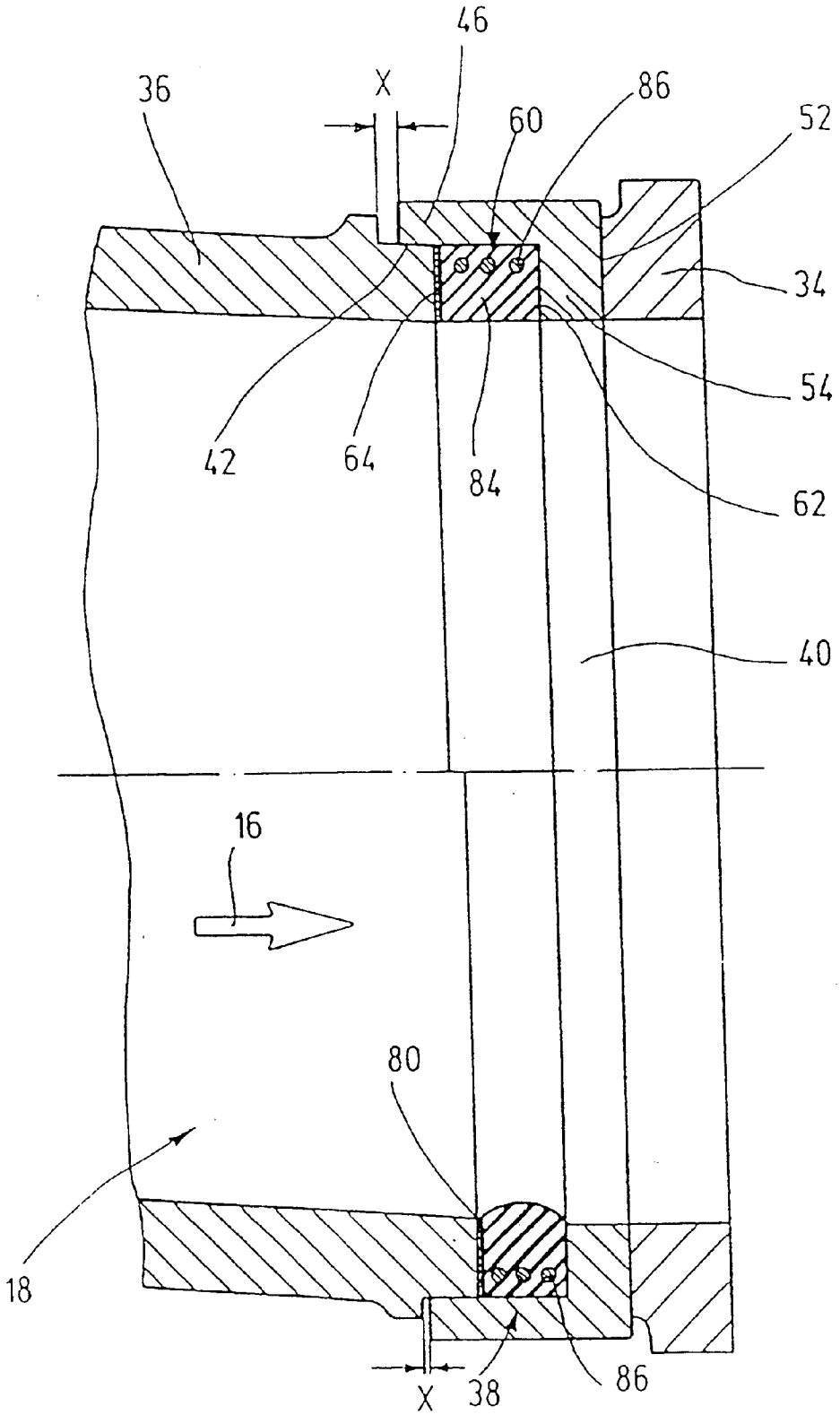
FIG. 3 an embodiment of a pipe switch deviating from FIG. 2 with externally centered wear ring in untensioned (upper) and pretensioned (lower) condition of the rubber elastic ring arrangement in sectional representation.
Figure 4:
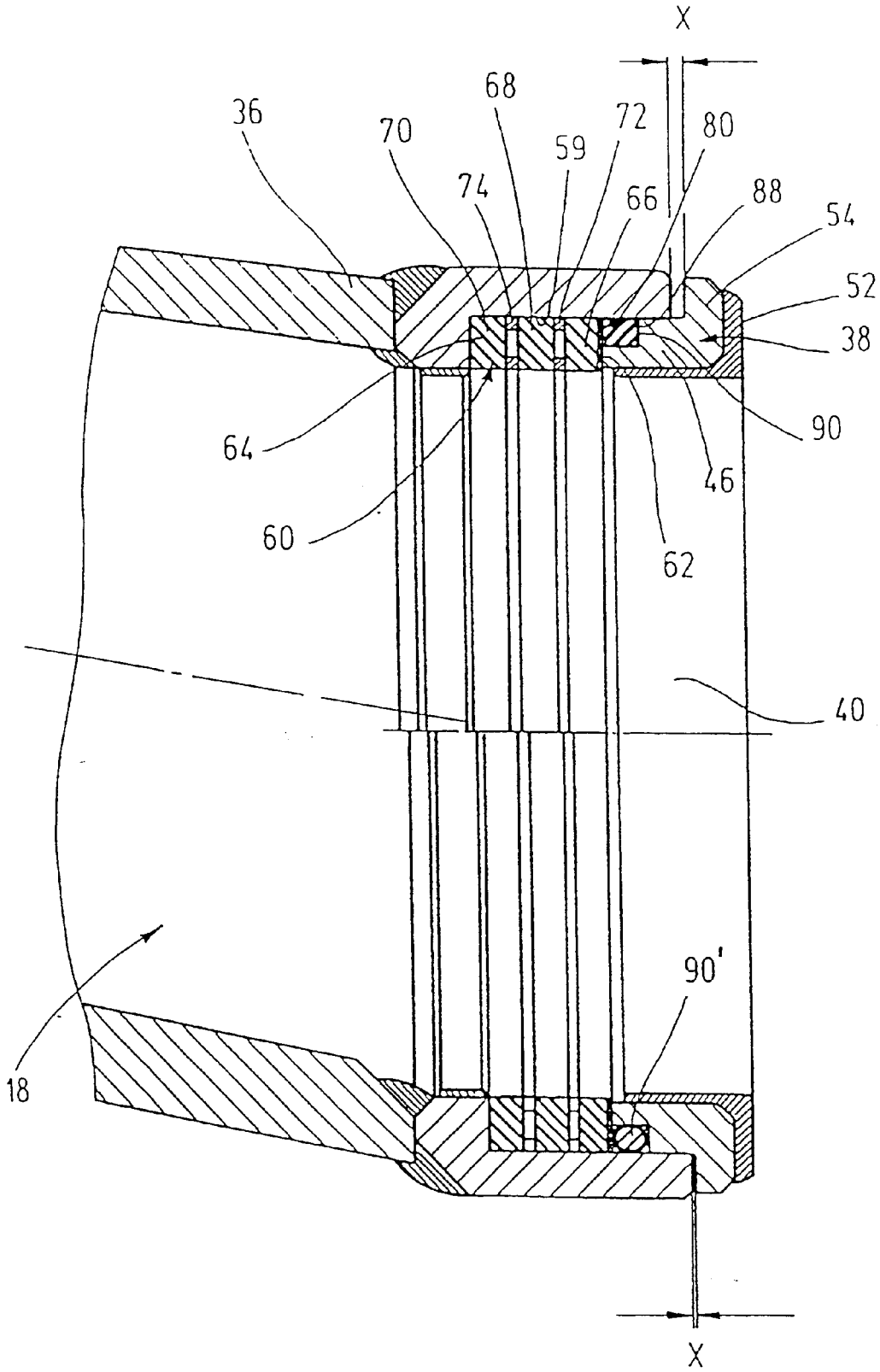
FIG. 4 an embodiment of a pipe switch deviating from FIG. 2 and FIG. 3 with internal centered wear ring and supplemental quadrilateral (upper) and round (lower) seal ring in sectional representation.

As can be seen from FIG. 2 through 4, the wear ring 38 beside the centering part 46 has a sealing part 54 lying with its cylinder side surface 52 against the wear plate 34. The pivot pipe 36 and the sealing part 54 of the wear ring 38 are besides this provided with opposing radial ring surfaces 56, 58 separated axially from each other and open to the pipe internal annular space 59. The annular space 59 is bridged over axially by a ring arrangement 60, which with its respective end faces 62, 64 lies against one of the annular surfaces 56, 58 under pretension. On the end face facing the centering part 46 of the wear ring 38 an axial ring overlay 80 is vulcanized onto the ring arrangement 60, which is comprised of a material which, in comparison to the rubber elastic material, is stiffer and more wear resistant, such as for example metal, textile weave, plastic or hard rubber. The abutment surface 82 on the wear ring 38 limits the axial movement of the wear ring 38 on the pivot pipe 36.

In the illustrative embodiment shown in FIG. 2 the ring arrangement 60 includes three rubber elastic rings 66, 68, 70, which are pairwise separated from each other via loosely introduced metallic intermediate rings 72, 74, and which can be connected with each other via angularly separated pins 76. The intermediate rings 72, 74 exhibit through-holes 78 in angular separation from each other, through which a part of the pin 76 extends. The axial ring overlay 80 is provided on the end surface of the rubber elastic ring 66 facing the centering part 46 of the wear ring 38.

In the illustrative embodiment according to FIG. 3 the ring arrangement 60 is formed by a one-piece rubber elastic ring 84, in which a helical spring 86 of spring steel is co-axially vulcanized in. The helical spring can be embedded in the rubber elastic material of the ring 84 either untensioned or pre-tensioned under pressure. In the later case, in the case of wear, at least a part of the pre-tension of the coil spring 86 is available for adjustment of the wear ring 38. Besides this the coil spring 86 insures that the ring arrangement 60 even in the case of low shore hardness of the rubber elastic material exhibits a sufficient circumferential stability, which would prevent a driving out or unseating of the ring arrangement 60 into the internal space of the pipe. In the illustrative embodiment according to FIG. 3 the wear ring 38 is guided with its centering part 46 on an outer centering surface 42 of the pivot pipe 36. In accordance therewith in this case the wear reducing axial ring overlay 80 is situated upon the surface 64 of the ring arrangement 60 facing the ring surface 58. In the operating condition the wear ring 38 is so tensioned against the wear plate 34 via the pivot pipe 36, that the gap width X between the wear ring 38 and the pivot pipe 36 in the area of the abutment 82 is reduced from 4 mm to 0.5–1 mm. The pre-tension stroke of 3–3.5 mm is converted to a transverse expansion of the rubber elastic component of the ring arrangement 60 towards the pipe inside, which is shown in the lower part of FIG. 3 as a bulge.

The embodiment according to FIG. 4 is different from the embodiment according to FIG. 2 above all therein, that the centering part 46 adjacent ring surface 56 includes an annular step 88 formed by a recess facing in the direction of the centering part 46, undercut with respect to the pipe inside, in which a ring seal 90, 90' of an elastomeric material separate from the ring arrangement 60 is seated. In the example shown in the upper part of FIG. 4, the ring seal 90 exhibits a quadrilateral cross-section, while the ring seal 90' in the lower part of FIG. 4 is formed as an O-ring. In both cases the ring seal 90, 90' is so over-dimensioned with respect to the axial recess of the annular step 88 that under the pre-tension of the ring arrangement 60 it is completely pressed into the annular step 88. In the upper part of FIG. 4 the unpresssed condition is shown with a gap width X of 3 mm and in the lower part in the compressed condition with a gap width X of 0.5–1 mm. The pre-tensioned stroke in the case of the wear of the sealing part 54 of the wear ring 38 and the wear plate 34 is available as adjustment stroke. Also in the illustrative embodiment according to FIG. 4 a wear reducing ring overlay 80 is provided on the centering part 46 facing surface 62 of the ring arrangement 60, which however is not necessary because of the supplemental sealing rings 90, 90'.

Figure 5:
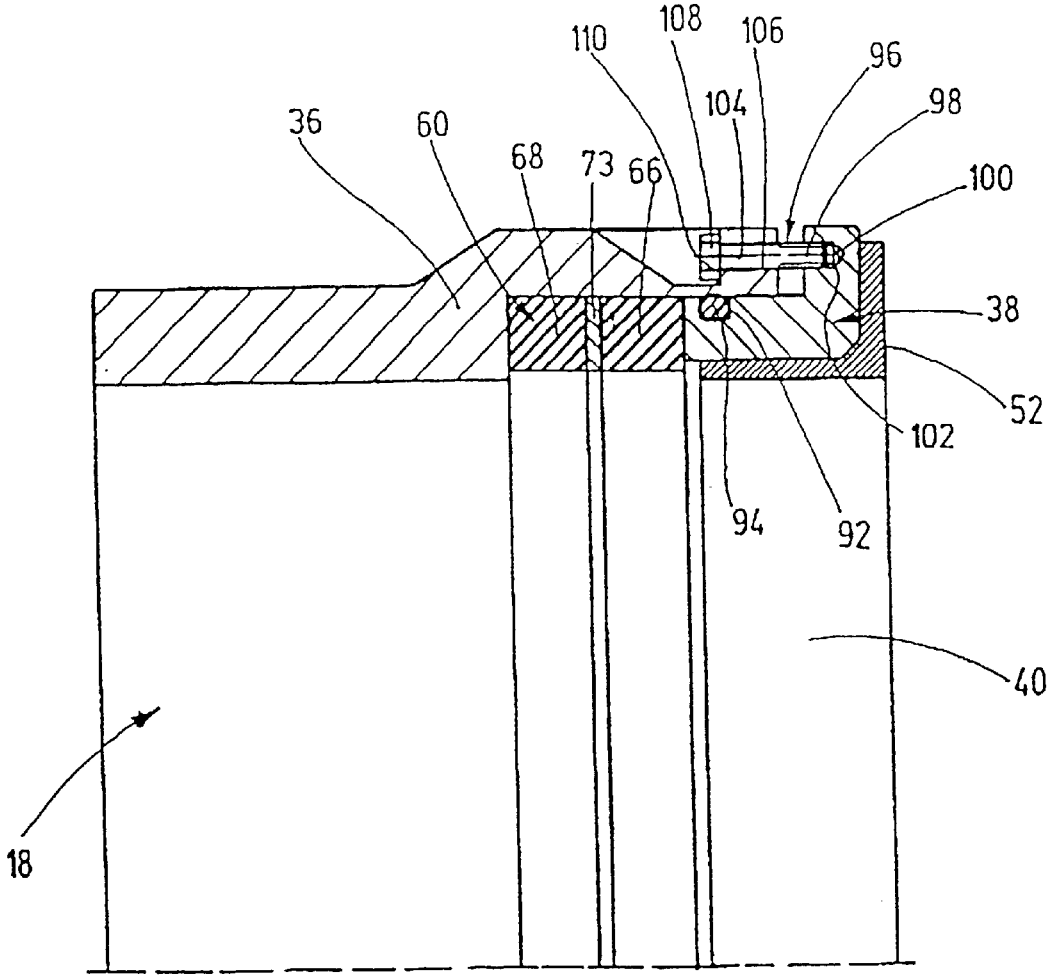
FIG. 5 a further deviating embodiment of a pipe switch with tensioning mechanism for the ring arrangement in sectional cut-through representation.

In the illustrative embodiment shown in FIG. 5, the ring arrangement 60 includes two rubber elastic rings 66, 68 between which a metallic intermediate ring 73 formed as a ring disk is provided. The rubber elastic rings 66, 68 are vulcanized onto the intermediate ring 73 on their surfaces facing the intermediate ring 73. The metallic intermediate ring 73 and the adjacent rubber elastic rings 66, 68 exhibit the same inner and outer radius. Further, a radially outwardly open annular tee-slot 92 is provided in the centering part 46 of the wear ring 38, wherein a ring seal 94 is introduced in the annular gap between the centering part 46 and the centering surface 42 of the pivot pipe 36 in a bridging manner. In order to insure that the pre-tension in the area of the ring arrangement remains maintained during increasing wear in the area of the cylinder side surface 52 of the wear ring 38, a supplemental tensioning mechanism 96 is provided positioned between the pivot pipe 36 and the wear ring 38. The tensioning mechanism 96 includes multiple, preferably three, tensioning screws 98 distributed positioned about the circumference of the pivot pipe, which with their tips 100 engage in an axially-parallel oriented threading 102 of the wear ring, with their shaft 104 extending through a radial edge open axial guide 106 of the pivot pipe 36 and with their from outside accessible head 108 lie against the radial guide 106 bordering pivot pipe associated shoulder 110. With the tensioning mechanism 98 a minimal pre-tension of the ring arrangement can be adjusted, so that no material to be conveyed can penetrate into the annular space 59 from the inside of the pipe. The ring seal 98 insures on the other hand therefore, that the annular space 59 is also sufficiently sealed with respect to the external situated material supply container.

In summary the following is to be concluded: The present invention relates to a pipe switch for a dual-cylinder thick-liquid pump, wherein said system comprises a pivoting pivot pipe 36 located in the front of a glasses-like wear plate 34 on the cylinder side as well as a wear ring 38 which is capable of limited axial displacement at the end of the pivot pipe 36 on the cylinder side. The ring can be pressed against the wear plate 34 by the hydrostatic pressure existing inside said pivot pipe. The wear ring 38 has a centering portion 46 guided on an axis-parallel centering surface 42 of the pivot pipe 36 as well as a sealing part 54 resting against the wear plate 34 through an abutment surface 52 on the cylinder side. The pivot pipe 36 and the sealing part 54 of the wear ring 38 have annular surfaces 56, 58 which face each other and which are axially spaced from one another by an annular gap 59 opened towards the inside of the pipe. An annular system 60 exhibiting at least a rubber elasticity is further provided, wherein said system axially covers the annular gap 59 and has its abutment surfaces 62, 64 resting in a prestressed manner against each of the annular surfaces 56, 58. In order to allow for an automatic anti-wear readjustment of the wear ring, the annular system 60 has an axial annular support 80 provided on its abutment surface 62 which faces the centering portion 46 of the wear ring 38, wherein said support 80 is made of a wear-resistant material which is more rigid than the rubber-elastic material.

What is claimed is:

1. Pipe switch for a two-cylinder thick material pump, with:

a wear plate (34) having two openings (12);

a pivot pipe (36) having a cylinder end and a conveyance end, the cylinder end pivotable in front of the two opening (12) wear plate (34);

a wear ring (38) which is capable of limited axial displacement at the cylinder end of the pivot pipe (36) and pressed against the wear plate (34) by the hydrostatic pressure existing inside said pivot pipe, the wear ring including a centering portion (46) guided on an axis-parallel centering surface (42) of the pivot pipe (36) as well as a sealing part (54) resting against the wear plate (34) via an abutment surface (52) on the cylinder side, wherein the pivot pipe (36) and the sealing part (54) of the wear ring (38) have opposing annular surfaces (56, 58) which are axially spaced from one another forming an annular gap (59) opened towards the inside of the pipe; and an annular ring arrangement (60) which is at least partially comprised of a rubber elastic material, wherein said annular ring arrangement axially bridges over the annular gap (59) and has abutment surfaces (62, 64) resting in a prestressed manner against each of the annular surfaces (56, 58), wherein the ring arrangement (60) is comprised of at least two rings (66, 68, 70) of rubber elastic material separated from each other by a stiff intermediate ring (72, 73, 64).

2. Pipe switch according to claim 1, wherein the intermediate ring (73) is a metallic ring, which has the same inner and outer diameter as the adjacent rubber elastic rings (66, 68).

3. Pipe switch according to claim 1, wherein the rubber elastic rings (66, 68, 70) are connected to each other via multiple axially parallel pins (76) provided in angular separation from each other.

4. Pipe switch according to claim 1, wherein the intermediate ring (72, 74) is inserted loosely between the rubber elastic rings (66, 68, 70) in the ring space (59).

5. Pipe switch according to claim 1, wherein the intermediate ring (72, 74) is provided with multiple through-holes (78) arranged in angular separation from each other.

6. Pipe switch according to claim 5, wherein pins (76) extend through the through holes (78) in the intermediate ring (72, 74).

7. Pipe switch according to claim 1, wherein the rubber elastic rings (66, 68) are vulcanized to the intermediate ring (73) at their contacting surfaces.

8. Pipe switch according to claim 1, wherein an annular groove (92) provided in the centering surface (42) of the pivot pipe (36) or in the centering part (46) of the wear ring (38), in which annular groove a ring seal (94) is provided bridging the annular gap between the centering surface (42) and the centering part (46).

9. Pipe switch according to claim 1, wherein a tensioning mechanism (96) is provided between the pivot pipe (36) and wear ring (38) for adjusting the pretension in the ring arrangement (60).

10. Pipe switch according to claim 1, wherein the ring arrangement (60) at least on said abutment surface (62) facing the centering part (46) of the wear ring (38) is provided with an axial ring overlay (80) of a material which is stiffer and more wear-resistant than the rubber elastic material.

11. Pipe switch according to claim 10, wherein the ring overlay (80) is comprised of metal.

12. Pipe switch according to claim 10, wherein the ring overlay (80) is comprised of a metal or textile fabric.

13. Pipe switch according to claim 10, wherein the ring overlay (80) is comprised of a plastic or of hard rubber.

14. Pipe switch according to claim 1, wherein a ring overlay (80) is adhered to or vulcanized onto the rubber elastic material of the ring arrangement (60).

15. Pipe switch for a two-cylinder thick material pump, with:

a wear plate (34) having two openings (12);

a pivot pipe (36) having a cylinder end and a conveyance end, the cylinder end pivotable in front of the two opening (12) wear plate (34);

a wear ring (38) which is capable of limited axial displacement at the cylinder end of the pivot pipe (36) and pressed against the wear plate (34) by the hydrostatic pressure existing inside said pivot pipe, the wear ring including a centering portion (46) guided on an axis-parallel centering surface (42) of the pivot pipe (36) as well as a sealing part (54) resting against the wear plate (34) via an abutment surface (52) on the cylinder side, wherein the pivot pipe (36) and the sealing part (54) of the wear ring (38) have opposing annular surfaces (56, 58) which are axially spaced from one another forming an annular gap (59) opened towards the inside of the pipe; and an annular ring arrangement (60) which is at least partially comprised of a rubber elastic material, wherein said annular ring arrangement axially bridges over the annular gap (59) and has abutment surfaces (62, 64) resting in a prestressed manner against each of the annular surfaces (56, 58), wherein the ring arrangement (60) is formed by a rubber elastic ring (84) with a co-axial vulcanized-in helical spring (86).

16. Pipe switch according to claim 15, wherein the helical spring (86) is comprised of spring elastic material.

17. Pipe switch according to claim 15, the helical spring (86) is pretensioned under pressure within the rubber elastic ring (84).

18. Pipe switch according to one of claims 1 through 10, wherein the ring surface (56) adjacent to the centering part (46) exhibits an annular step (88) formed by a recess opening in the direction of the centering part (46), undercut with respect to the pipe inside, thereby characterized, that a ring seal (90, 90') of elastomeric material separate from the ring arrangement is introduced in the annular step (88).

19. A pipe switch according to claim 16 wherein the elastic spring material is spring steel.

20. Pipe switch for a two-cylinder thick material pump, with:

a wear plate (34) having two openings (12);

a pivot pipe (36) having a cylinder end and a conveyance end, the cylinder end pivotable in front of the two opening (12) wear plate (34);

a wear ring (38) which is capable of limited axial displacement at the cylinder end of the pivot pipe (36) and pressed against the wear plate (34) by the hydrostatic pressure existing inside said pivot pipe, the wear ring including a centering portion, (46) guided on an axis-parallel centering surface (42) of the pivot pipe (36) as well as a sealing part (54) resting against the wear plate (34) via an abutment surface (52) on the cylinder side, wherein the pivot pipe (36) and the sealing part (54) of the wear ring (38) have opposing annular surfaces (56, 58) which are axially spaced from one another forming an annular gap (59) opened towards the inside of the pipe; and an annular ring arrangement (60) which is at least partially comprised of a rubber elastic material, wherein said annular ring arrangement axially bridges over the annular gap (59) and has abutment surfaces (62, 64) resting in a prestressed manner against each of the annular surfaces (56, 58), wherein the ring surface (56) adjacent to the centering part (46) exhibits a annular step (88) formed by a recess open towards the centering part (46), undercut with respect to the pipe inside, and wherein in the annular step (88) a ring seal (90, 90') of elastomeric material separate from the ring arrangement is introduced.

21. Pipe switch according to claim 20, wherein the seal ring (90, 90') is over-dimensioned in comparison to the annular step (88).

22. Pipe switch according to claim 20, wherein the seal ring (90) exhibits a quadrilateral or quadric cross-section.

23. Pipe switch according to claim 20, wherein the ring seal (90') exhibits a round or oval cross-section.

24. Pipe switch for a two-cylinder thick material pump, with:

a wear plate (34) having two openings (12);

a pivot pipe (36) having a cylinder end and a conveyance end, the cylinder end pivotable in front of the two opening (12) wear plate (34);

a wear ring (38) which is capable of limited axial displacement at the cylinder end of the pivot pipe (36) and pressed against the wear plate (34) by the hydrostatic pressure existing inside said pivot pipe, the wear ring including a centering portion (46) guided on an axis-parallel centering surface (42) of the pivot pipe (36) as well as a sealing part (54) resting against the wear plate (34) via an abutment surface (52) on the cylinder side, wherein the pivot pipe (36) and the sealing part (54) of the wear ring (38) have opposing annular surfaces (56, 58) which are axially spaced from one another forming an annular gap (59) opened towards the inside of the pipe; and an annular ring arrangement (60) which is at least partially comprised of a rubber elastic material, wherein said annular ring arrangement axially bridges over the annular gap (59) and has abutment surfaces (62, 64) resting in a prestressed manner against each of the annular surfaces (56, 58), wherein a tensioning mechanism (96) is provided between the pivot pipe (36) and the wear ring (38) for adjusting the pretension in the ring arrangement (60).

25. Pipe switch according to claim 24, wherein the tensioning mechanism is comprised of at least two tensioning screws (98) distributed about the circumference of the pivot pipe (36) and displaceable axially parallel with respect to the pivot pipe, said tensioning screws (98) engaging in respectively one axially-parallel threading (102) of the wear ring (38).

26. Pipe switch according to claim 25, wherein the tensioning screws (98) are formed as set screws and are guided with their shafts respectively in one radial edge open axial guide (106) of the pivot pipe (36) and with their head (108) are supportable against a shoulder (110) adjacent the axial guide.

* * * * *